US011291298B2

(12) United States Patent
Xiang et al.

(10) Patent No.: US 11,291,298 B2
(45) Date of Patent: Apr. 5, 2022

(54) LIFTING TABLE

(71) Applicant: LOCTEK ERGONOMIC TECHNOLOGY CORP., Ningbo (CN)

(72) Inventors: Lehong Xiang, Ningbo (CN); Tao Lin, Ningbo (CN); Fang Wu, Ningbo (CN)

(73) Assignee: LOCTEK ERGONOMIC TECHNOLOGY CORP., Ningbo (CN)

( * ) Notice: Subject to any disclaimer, the term of this patent is extended or adjusted under 35 U.S.C. 154(b) by 0 days.

(21) Appl. No.: 16/888,814

(22) Filed: May 31, 2020

(65) Prior Publication Data

US 2020/0375351 A1 Dec. 3, 2020

(30) Foreign Application Priority Data

May 31, 2019 (CN) ..... 201910469082.7

(51) Int. Cl.
*A47B 9/16* (2006.01)
*B66F 7/06* (2006.01)

(52) U.S. Cl.
CPC ..... *A47B 9/16* (2013.01); *B66F 7/065* (2013.01)

(58) Field of Classification Search
CPC ..... A47B 9/16; B66F 7/065
See application file for complete search history.

(56) References Cited

U.S. PATENT DOCUMENTS

| | | | | |
|---|---|---|---|---|
| 9,615,655 | B1 * | 4/2017 | Huang | A47B 9/02 |
| 10,258,148 | B1 * | 4/2019 | Donner | A47B 9/18 |
| 10,842,257 | B2 * | 11/2020 | Fletcher-Price | A47B 21/02 |
| 2018/0146775 | A1 * | 5/2018 | You | A47B 9/16 |
| 2018/0184797 | A1 * | 7/2018 | Chuang | A47B 9/16 |
| 2019/0110588 | A1 * | 4/2019 | Wong | A47B 21/02 |
| 2020/0298599 | A1 * | 9/2020 | Tsuchiya | B41J 29/06 |
| 2021/0062842 | A1 * | 3/2021 | Chen | A47B 9/16 |

FOREIGN PATENT DOCUMENTS

CN 105124920 A 12/2015

* cited by examiner

*Primary Examiner* — Daniel J Rohrhoff
(74) *Attorney, Agent, or Firm* — W&KIP

(57) ABSTRACT

The present invention has a lifting table, comprising an upper platform, a lower platform, and at least one group of lifting component positioned between the upper and lower platforms and used for adjusting the height of the upper platform relative to the lower platform; the lifting table further comprises elastic elements and sliding components sliding fit on the upper or lower platform; the sliding components are connected with the elastic elements for sliding on the upper or lower platform under the effect of elastic forces from the elastic elements; each sliding component has a push part, the lifting component exerts an acting force to the push part so that the sliding component overcomes the elastic force of the elastic element to slide along the upper or lower platform, and is simple and labor-saving in operation and good in user experience.

10 Claims, 6 Drawing Sheets

LIFTING TABLE

CROSS-REFERENCE TO RELATED APPLICATIONS

This application claims priority to Chinese Patent Application No. 201910469082.7 with a filing date of May 31, 2019. The content of the aforementioned applications, including any intervening amendments thereto, are incorporated herein by reference.

TECHNICAL FIELD

The present invention relates to the field of a computer bearing technology, in particular to a lifting table.

BACKGROUND

With continuous social development, we have an easy access to flat panel displays (FPDs), table personal computers (PCs) and the like, stimulating emerging of matched stands thereof. In the prior art, a lifting table (also called a lifting worktable) for bearing a table personal computer is generally placed on a desk top or table top, taking the application for a patent with the publication No. CN105124920A entitled "LIFTING TABLE" in the website of the CNIPA as an example. In this application, the lifting table structurally comprises an upper platform, a lower platform, and at least one group of X-shaped lifting mechanism between the upper and lower platforms. Each group of X-shaped lifting mechanism consists of a first strut and a second strut of which the middle portions are mutually hinged to form an X shape. A first hinging seat secured on the lower platform and a second hinging seat capable of sliding relative to the lower platform are mounted on the lower platform. A third hinging seat secured on the upper platform and a fourth hinging seat capable of sliding relative to the upper platform are mounted on the upper platform. The lifting table further comprises elastic elements for counteracting or partially counteracting the weight borne by the upper platform. One end of the elastic element is hinged with the first or second strut, while the other end thereof is hinged on the upper or lower platform. There also provide pins on the upper platform, which are controlled to be inserted into or separated from slotted holes by means of stay cables and levers. In the lifting table with the above-mentioned structure, when the upper and lower platforms are folded to the lowest position, the elastic elements are approximately horizontal, and exert a minimum even negligible lifting force to the upper platform. In particular for some ultra-thin lifting tables, in order to minimize their folded thicknesses, the elastic elements are horizontal when the upper and lower platforms are folded to the lowest position, at this point, no lifting force is applied to the upper platform from the elastic elements. Consequently, when the lifting table with its upper and lower platforms folded to the lowest position needs to expand, it is necessary to use hands to separate the upper platform from the lower platform, that is, an external force applied by the hands serves as the lifting force of the upper platform to rise when it is at the lowest position. Apparently, the above operation is troublesome and labored, and user experience is very poor.

SUMMARY

The technical problem to be resolved by the present disclosure is to provide a lifting table, which is capable of effectively providing an upward force for the upper platform to rise when the upper platform needs to expand after folded to the lowest position with the lower platform, and is simple and labor-saving in operation and good in user experience, for overcoming the forgoing defects in the prior art.

The technical solution used in the present disclosure provides a lifting table structurally comprising an upper platform, a lower platform, and at least one group of lifting component positioned between the upper and lower platforms and used for adjusting the height of the upper platform relative to the lower platform. The lifting table also comprises elastic elements and sliding components sliding fit on the upper or lower platform. The sliding components are connected with the elastic elements for sliding on the upper or lower platform under the effect of elastic forces from the elastic elements. Each sliding component has a push part, and in the process of upward expanding the upper platform from the lowest position, the sliding component slides with the aid of the elastic force of the elastic element and enables the push part to apply an upward lifting force to the lifting component, so that the upper platform displaces relative to the lower platform. When the upper platform is folded toward the lowest position, the lifting component exerts an acting force to the push part so that the sliding component overcomes the elastic force of the elastic element to slide along the upper or lower platform.

As compared to the prior art, the lifting table with the above-mentioned structure has the following advantages that the lifting table is provided with a sliding component on the upper or lower platform, the sliding component is connected with an elastic element, the sliding component is driven to slide along the upper or lower platform under the effect of the elastic force of the elastic element, and a push part of the sliding component applies an upward lifting force to the lifting component. By virtue of the elastic element, the sliding component of the lifting table horizontally slides to apply an upward lifting force to the lifting component, in such a case, when the upper platform upward expands from the lowest position, an upward force can be effectively provided for the upper platform to rise so as to quickly expand the upper platform. The lifting table is simple in structure, and good in user experience.

In some embodiment, the lifting component is an X-shaped lifting arm component comprising at least one first strut and at least one second strut. The lower end of the first strut is hinged on the lower platform, the upper end of the first strut is connected with a first slider, and the first slider is slidably connected to the upper platform. The upper end of the second strut is hinged on the upper platform, the lower end of the second strut is connected with a second slider, and the second slider is slidably connected to the lower platform.

In some embodiment, the elastic elements comprise at least one first elastic component and at least one second elastic component. One end of the first elastic component is connected with the first slider, and the other end thereof is connected to the upper platform for exerting an elastic tensile force to the first slider. One end of the second elastic component is connected with the second slider, and the other end thereof is connected to the lower platform for exerting an elastic tensile force to the second slider. The first and second elastic components of the elastic elements are springs. When the upper platform is folded to the lowest position, the first slider drives the first elastic component to elastically expand, and the second slider drives the second elastic component to elastically expand. When the upper platform expands upward from the lowest position, the first and second sliders are driven by the elastic forces of the first and second elastic components to slide so as to lift the upper platform.

In some embodiment, the sliding component is in sliding fit on the upper platform. One end of the first elastic component is connected with the sliding component, and the other end thereof is connected to the upper platform. The sliding component is connected with the first slider via at least one linkage mechanism. The sliding component is driven to slide with the help of the elastic force of the first elastic component and the first slider is driven to slide by the linkage mechanism so as to lift the upper platform. Due to the above arrangement, another elastic component for driving the sliding component to slide is freed, therefore, structure is simple, and manufacture cost is low.

In some embodiment, the push part is a guide surface of which one end is low, the other end is high, and the middle is in smooth transition, mounted on the sliding component. One side of the first strut proximal the first slider is connected with a roller. When the upper platform is at the lowest position, the outer rim of the roller clings to the guide surface. When the upper platform expands upward from the lowest position, the first elastic component drives the sliding component to slide under the effect of the elastic force and enables the guide surface of the push part to push the roller so that the first strut is on the rise. The guide surface on the sliding component can push the roller on the first strut while sliding along with the sliding component, therefore, the first strut is on the rise. That is to say, an elastic force of the first elastic component is used by the sliding component to be converted into a lifting force for the first strut to rise via the guide surface so that it is easy to expand the upper platform when at the lowest position.

In some embodiment, each linkage mechanism comprises a connecting rod. The first end of the connecting rod is rotatably connected with the first slider, and the second end of the connecting rod is connected with a limiting block. The sliding component is provided with a sliding chute extending along the sliding direction of the sliding component. The limiting block is received within the sliding chute by sliding fit. When the upper platform is at the lowest position, a movable space is reserved between one end of the sliding chute proximal the first slider and the limiting block. When the upper platform expands upward from the lowest position, owing to the movable space between one end of the sliding chute proximal the first slider and the limiting block, the elastic force of the first elastic component is all applied to the sliding component to make it slide along the upper platform, and meantime the push part of the sliding component pushes the first strut to rise. After the first strut rises to a certain height, the inner wall of one end of the sliding chute proximal the first slider abuts the limiting block, and by driving the first slider to slide by the connecting rod, the first strut continuously rises, by this time, the push part of the sliding component disengages the roller on the first strut. Due to this arrangement, when the upper platform expands upward from the lowest position, the elastic force of the first elastic component is all applied to the sliding component so that the push part of the sliding component can rapidly push the first strut to rise so as to expand the upper platform.

In some embodiment, there are two linkage mechanisms at two sides of the sliding component respectively. By means of the set linkage mechanisms, the sliding component may drive the first slider to slide uniformly, thereby ensuring steadiness of the upper platform in its rising process. In some embodiment, the lifting table also comprises a locking mechanism for locking lifting height of the upper platform. An operating handle connected with the locking mechanism for controlling locking or unlocking of the locking mechanism is further disposed on the upper platform.

In some embodiment, the locking mechanism comprises a locking bar connected with and synchronously sliding with the first slider. The sliding bar has a plurality of locking teeth along the length direction. The locking mechanism also comprises a latch retainer secured on the upper platform, and at least one latch for clamping fit with the locking teeth is elastically connected inside the latch retainer. The locking mechanism further comprises a connecting plate connected with the operating handle, the end part of the connecting plate is provided with a stopper for pushing the latch, and a reset spring is disposed on the connecting plate. The locking bar penetrates through the latch retainer to fit the latch. The connecting plate penetrates through the latch retainer to fit the latch. The operating handle is pulled to push the connecting plate, the stopper on the connecting plate pushes the latch in the latch retainer to open towards two sides, and the latch disengages the locking teeth of the locking bar, in such a case, the locking mechanism is at an unlocking state. The operating handle is released, the connecting plate resets, the latch moves toward the middle, and the latch and the locking teeth of the locking bar are clamped, in such a case, the locking mechanism is at a locking state. The above locking structure in which the connecting rod and the locking bar are directly used for locking contributes to steady locking and whole thinned locking mechanism, thereby making the lowest position of the whole lifting table become further lower.

In some embodiment, the guide surface presents a bevel in linear transition or a cambered face in smooth transition. The bevel in linear transition or cambered face in smooth transition serving as the guide surface favors of converting an elastic force of the first elastic component in the horizontal direction into an upward lifting force of the first strut, and ensuring steadiness of the upper platform in the rising process.

In some embodiment, two first elastic components and two second elastic components are provided. One ends of the two first elastic components are connected with the sliding component respectively, and the other ends thereof are connected to the upper platform respectively. One ends of the two second elastic components are connected with the second slider respectively, and the other ends thereof are connected to the lower platform respectively.

DETAILED DESCRIPTION OF THE DRAWINGS

Figure 1:
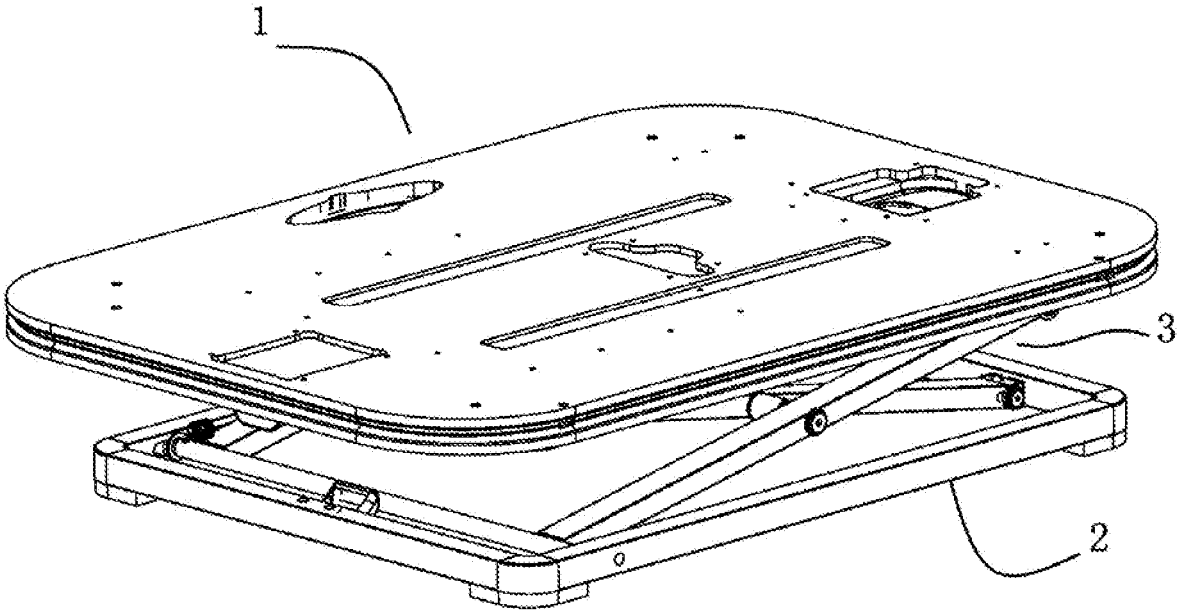
FIG. 1 shows a schematically structural diagram of a front face of a lifting table of the present invention.
Figure 2:
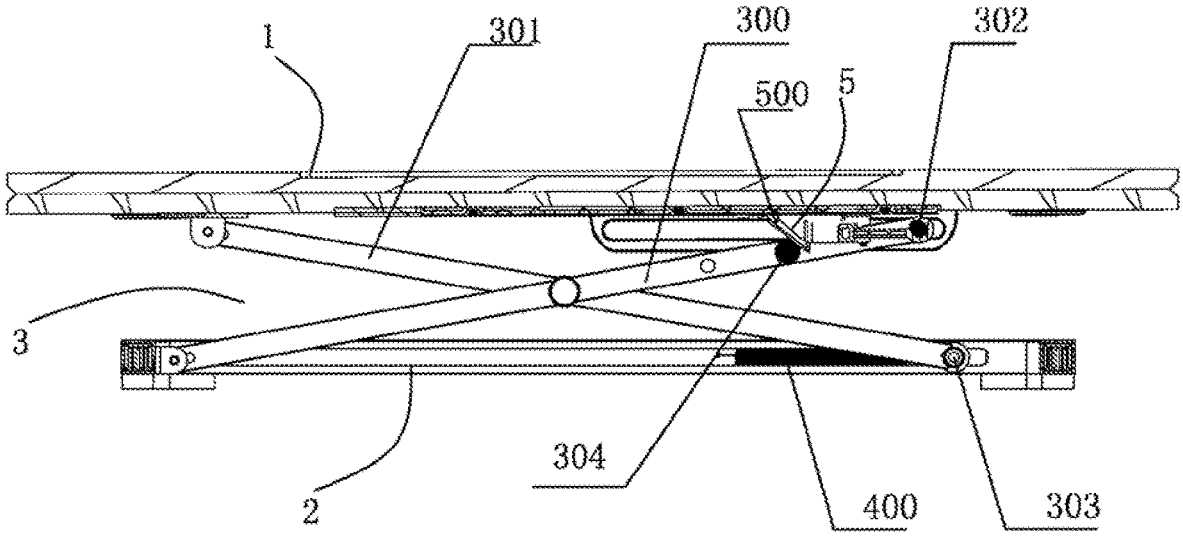
FIG. 2 shows a schematically structural diagram of a side face of the lifting table of the present invention.
Figure 3:
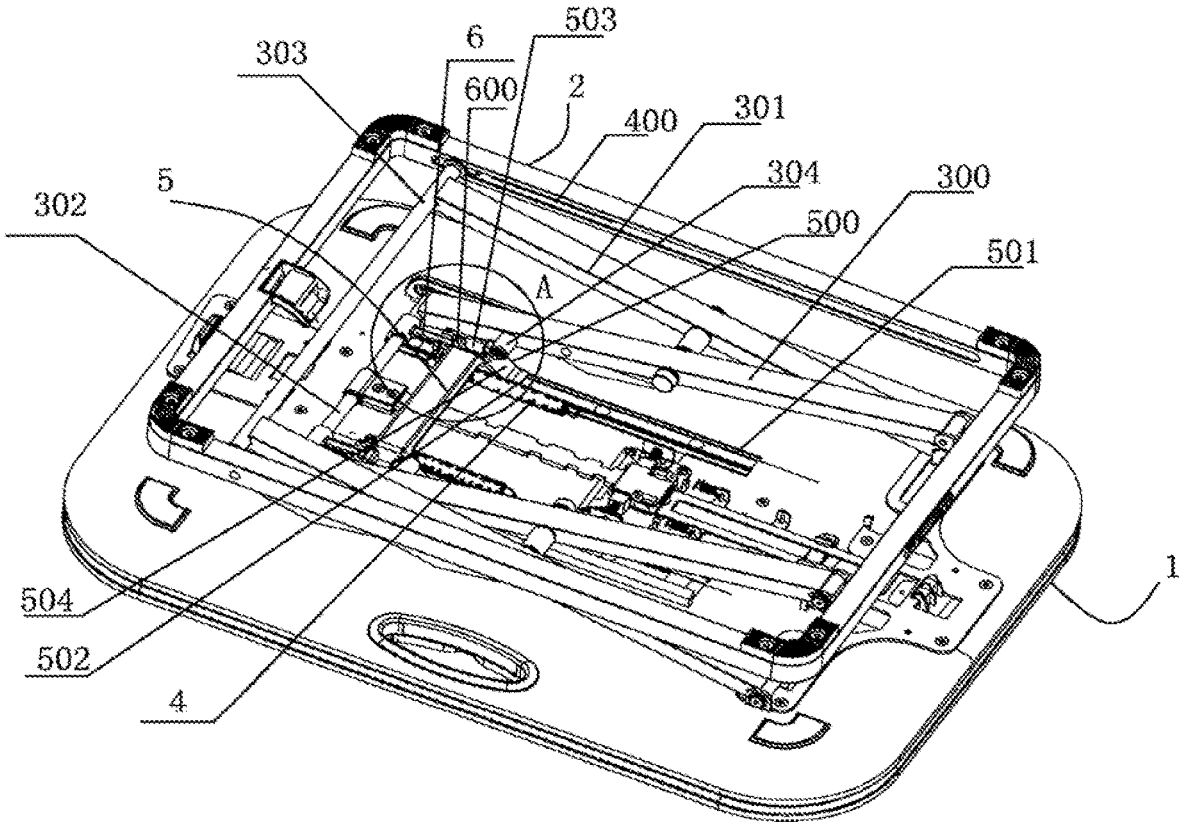
FIG. 3 shows a schematically structural diagram of a bottom face of the lifting table of the present invention.

The reference numerals denote: 1 upper platform; 2 lower platform; 3 X-shaped lifting arm component; 300 first strut; 301 second strut; 302 first slider; 303 second slider; 304 roller; 4 first elastic component; 400 second elastic component; 5 sliding component; 500 push part; 501 slide rail; 502 clamping slot; 5.3 sliding chute; 504 guide surface; 505 gap; 6 connecting rod; 600 limiting block; 601 rotating sleeve; 7 latch retainer; 700 latch; 701 locking bar; 702 locking teeth; 703 connecting plate; 704 stopper; 705 reset spring.

EMBODIMENTS

The present invention will be further explained in the following embodiments with reference to the accompanying drawings.

As shown in FIGS. 1, 2, 3, 4 and 6, the present invention discloses a lifting table, comprising an upper platform 1, a lower platform 2, and at least one group of lifting component positioned between the upper platform 1 and the lower platform 2 and used for adjusting the height of the upper platform 1 relative to the lower platform 2. The lifting table also comprises elastic elements and sliding components 5 sliding fit on the upper platform 1 or lower platform 2. The sliding components 5 are connected with the elastic elements for sliding along the upper platform 1 or lower platform 2 under the effect of elastic forces from the elastic elements. Each sliding component 5 has a push part 500, and when the upper platform 1 upward expands from the lowest position, the sliding component 5 slides with the aid of an elastic force of the elastic element and enables the push part 500 to apply an upward lifting force to the lifting component, so that the upper platform 1 displaces relative to the lower platform 2. When the upper platform 1 is folded toward the lowest position, the lifting component exerts an acting force to the push part 500 so that the sliding component 5 overcomes the elastic force of the elastic element to slide along the upper platform 1 or lower platform 2. By means of the elastic element, the sliding component of the lifting table horizontally slides to exert an upward lifting force to the lifting component, therefore when the upper platform upward expands from the lowest position, an upward force can be effectively provided for the upper platform to rise so as to rapidly expand the upper platform. The lifting table is simple in structure and good in user experience.

The lifting component is an X-shaped lifting arm component 3 comprising at least one first strut 300 and at least one second strut 301. The lower end of the first strut 300 is hinged on the lower platform 2, the upper end of the first strut 300 is connected with a first slider 302, and the first slider 302 is slidably connected to the upper platform 1. The upper end of the second strut 301 is hinged on the upper platform 1, the lower end of the second strut 301 is connected with a second slider 303, and the second slider 303 is slidably connected to the lower platform 2. At the bottom of the upper platform 1, two elongated sliding holes are formed in symmetry. Two ends of the first slider 302 are positioned within the two elongated sliding holes by sliding fit. Chutes with two opposite openings are formed on the lower platform 2. Two ends of the second slider 303 are positioned in the two chutes by sliding fit. In this embodiment, the sliding component 5 is in sliding fit on the bottom of the upper platform, that is, the bottom of the upper platform is provided with a slide rail 501. A clamping chute 502 in sliding fit with the slide rail 501 is formed on the sliding component. The clamping chute 502 of the sliding component 5 is clamped on the slide rail 501 and slides along the slide rail 501.

The elastic elements comprise at least one first elastic component 4 and at least one second elastic component 400. One end of the first elastic component 4 is connected with the first slider 302, and the other end thereof is connected to the upper platform 1 for exerting an elastic tensile force to the first slider 302. One end of the second elastic component 400 is connected with the second slider 303, and the other end thereof is connected to the lower platform 2 for exerting an elastic tensile force to the second slider 303. The first and second elastic components of the elastic elements are springs. When the upper platform is folded to the lowest position, the first slider drives the first elastic component to elastically expand, and the second slider drives the second elastic component to elastically expand. When the upper platform expands upward from the lowest position, driven by the elastic forces of the first and second elastic components, the first and second sliders slide, therefore the upper platform rises. The circumstance that the upper platform is folded to the lowest position means the upper platform is folded toward the lower platform so as to minimize the spacing between the upper platform and the lower platform, and the position where the upper platform is after folding is the lowest position.

In this embodiment, the sliding component 5 is in sliding fit on the upper platform 1. One end of the first elastic component 4 is connected with the sliding component 5, and the other end thereof is connected to the upper platform 1. The sliding component 5 is connected with the first slider 302 via at least one linkage mechanism. The sliding component 5 is driven to slide with the help of the elastic force of the first elastic component 4 and the first slider 302 is driven to slide by the linkage mechanism, so that the upper platform 1 rises. Due to the above arrangement, another elastic component for driving the sliding component to slide is freed, thereby having a simple structure, and reducing manufacture cost.

The push part 500 refers to a guide surface 504 of which one end is low, the other end is high, and the middle is in smooth transition, mounted on the sliding component 5. One side of the first strut 300 proximal the first slider 302 is connected with a roller 304. When the upper platform 1 is at the lowest position, the outer rim of the roller 304 clings to the guide surface 504. When the upper platform 1 expands upward from the lowest position, the first elastic component 4 drives the sliding component 5 to slide under the effect of the elastic force and enables the guide surface 504 of the push part 500 to push the roller 304, so that the first strut 300 is on the rise. The guide surface of the sliding component can push the roller on the first strut while sliding along with the sliding component, so that the first strut is on the rise. That is to say, an elastic force of the first elastic component is used by the sliding component to be converted into a lifting force for the first strut to rise via the guide surface so that it is easy to expand the upper platform when at the lowest position.

Figure 6:
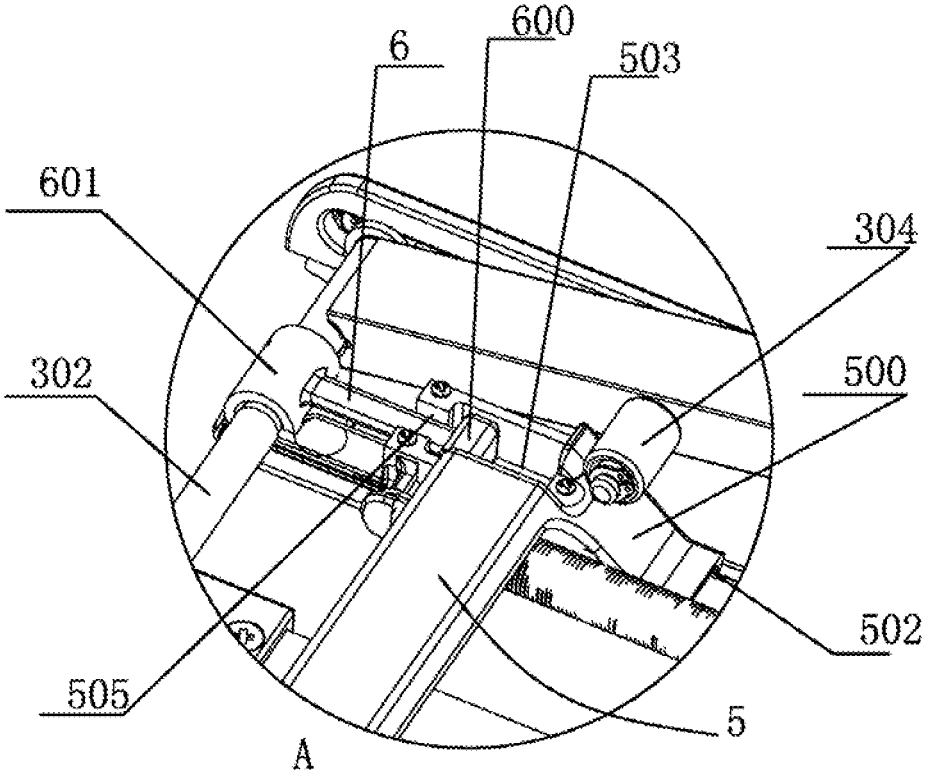
FIG. 6 shows an enlarged view of Portion A in FIG. 3 of the lifting table of the present invention.

Further referring to FIG. 6, each linkage mechanism comprises a connecting rod 6. The first end of the connecting rod 6 is connected with a rotating sleeve 601 which sleeves the first slider. Both the rotating sleeve 601 and the first slider 302 are rotatable. The second end of the connecting rod 6 is connected with a limiting block 600. The sliding component 5 is provided with a sliding chute 503 extending along the sliding direction of the sliding component 5. The limiting block 600 is received within the sliding chute 503 by sliding fit. When the upper platform 1 is at the lowest position, a movable space is reserved between one end of the sliding chute 503 proximal the first slider 302 and the limiting block 600. On one side wall of the sliding chute 503 proximal the first slider, a gap 505 is formed for the connecting rod 6 to pass through. When the upper platform expands upward from the lowest position, owing to the movable space between one end of the sliding chute proximal the first slider and the limiting block, the elastic force of the first elastic component 4 is all applied to the sliding component 5 to make it slide along the upper platform 1, and meantime the push part 500 of the sliding component 5 pushes the first strut 300 to rise. When the first strut 300 rises to a certain height, the inner wall of one end of the sliding chute 503 proximal the first slider 302 abuts the limiting block 600, and by driving the first slider 302 to slide via the connecting rod 6, the first strut 300 continuously rises, by this time, the push part 500 of the sliding component 5 disengages the roller 304 on the first strut 300. Due to this arrangement, when the upper platform 1 expands upward from the lowest position, the elastic force of the first elastic component 4 is all applied to the sliding component 5 so that the push part 500 of the sliding component 5 can rapidly push the first strut 300 to rise so as to expand the upper platform 1.

There are two linkage mechanisms at two sides of the sliding component 5 respectively.

Figure 4:
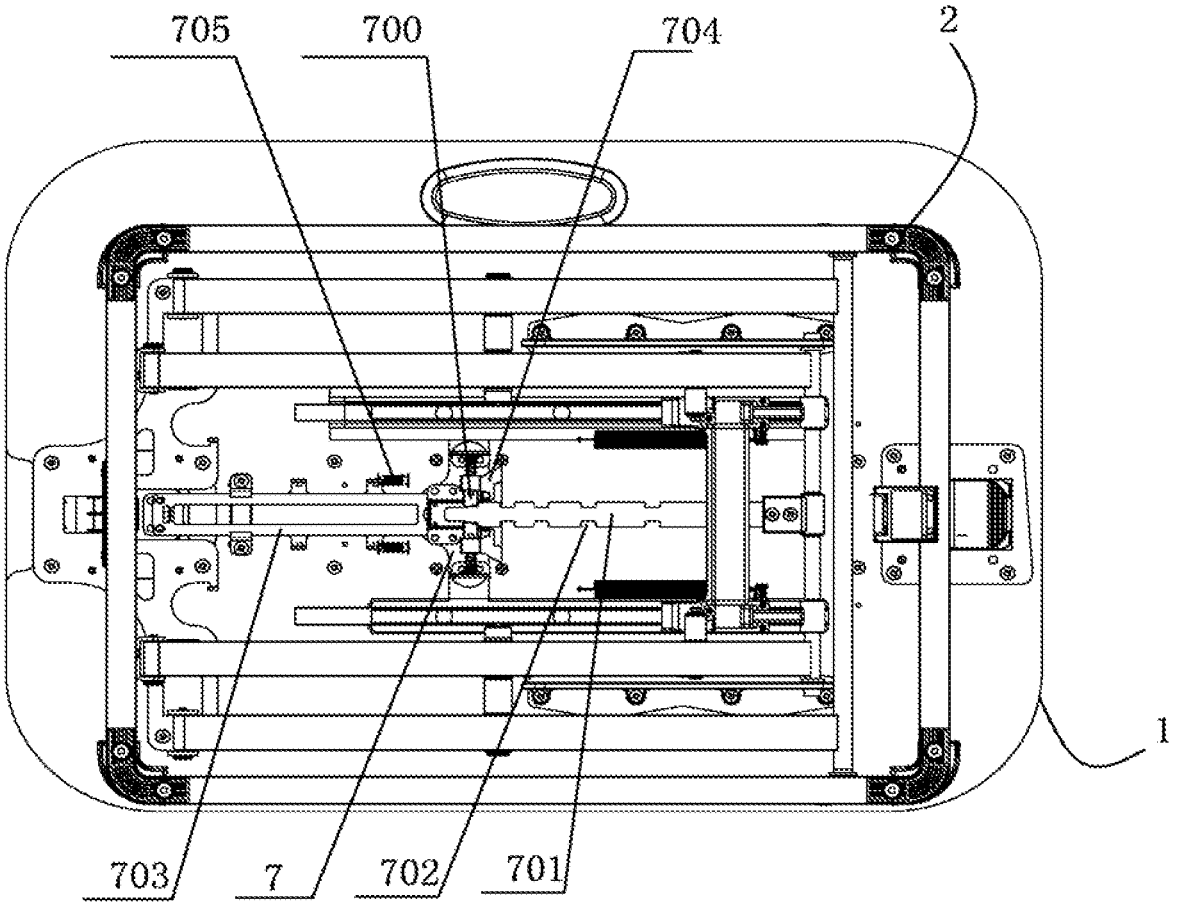
FIG. 4 shows a bottom view of the lifting table of the present invention.
Figure 5:
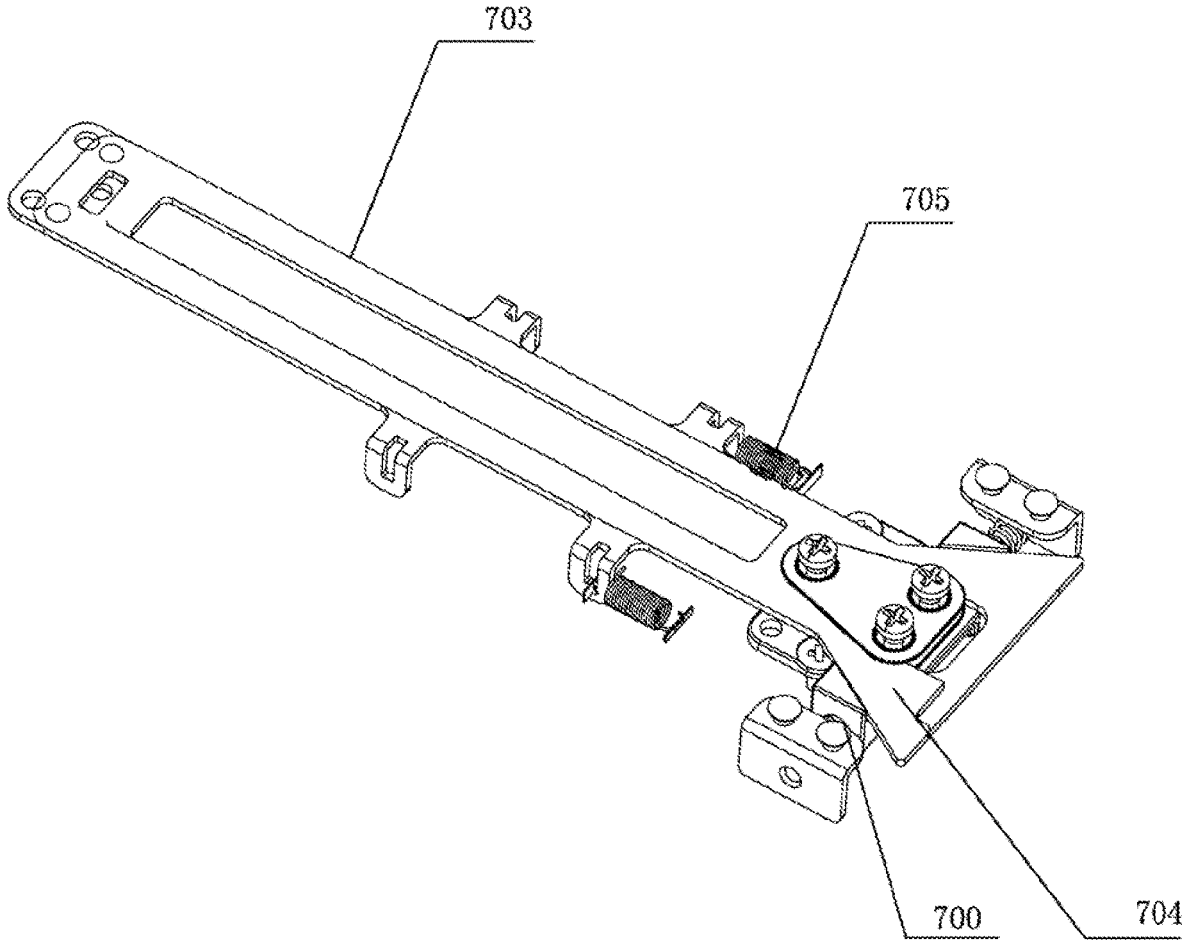
FIG. 5 shows a schematically structural diagram of a locking mechanism of the lifting table of the present invention.

As shown in FIGS. 4 and 5, the lifting table also comprises a locking mechanism for locking lifting height of the upper platform 1. An operating handle connected with the locking mechanism for controlling locking or unlocking of the locking mechanism is further disposed on the upper platform 1.

The locking mechanism comprises a locking bar 701 connected with and synchronously sliding with the first slider 302. The sliding bar 701 has a plurality of locking teeth 702 along the length direction. The locking mechanism also comprises a latch retainer 7 secured on the upper platform 1, and at least one latch 700 for clamping fit with the locking teeth 702 is elastically connected inside the latch retainer 7. The locking mechanism further comprises a connecting plate 703 connected with the operating handle, the end part of the connecting plate 703 is provided with a stopper 704 for pushing the latch 700, and a reset spring 705 is disposed on the connecting plate 703. The locking bar 701 penetrates through the latch retainer 7 to fit the latch 700. The connecting plate 703 penetrates through the latch retainer 7 to fit the latch 700. The operating handle is pulled to push the connecting plate 703, the stopper 704 on the connecting plate 703 pushes the latch 700 in the latch retainer 7 to open towards two sides, and the latch 700 disengages the locking teeth 702 of the locking bar 701, in such a case, the locking mechanism is at an unlocking state. The operating handle is released, the connecting plate 703 resets under the effect of the reset spring 705, the latch 700 moves toward the middle, and the latch 700 and the locking teeth 702 of the locking bar 701 are clamped, in such a case, the locking mechanism is at a locking state. The stopper 704 is of an isosceles triangle shape, for pushing the latch 700 outward in movement.

The guide surface 504 presents a bevel in linear transition or a cambered face in smooth transition. The bevel in linear transition or cambered face in smooth transition serving as the guide surface favors of converting an elastic force of the first elastic component in the horizontal direction into an upward lifting force of the first strut, and ensuring steadiness of the upper platform in its rising process.

Two first elastic components 4 and two second elastic components 400 are provided. One ends of the two first elastic components 4 are connected with the sliding component 5 respectively, and the other ends thereof are connected to the upper platform 4 respectively. One ends of the two second elastic components 400 are connected with the second slider 303 respectively, and the other ends thereof are connected to the lower platform 2 respectively. The described above is merely the embodiments of the present invention, but its protection scope is never limited thereto. Meanwhile, any variations or substitutions which easily occur to a skilled person in the art and are contained in the scope of the disclosure of the present invention, shall be covered by the protection scope of the present invention. Therefore, the claims should prevail over the protection scope of the present invention.

We claim:

1. A lifting table, comprising an upper platform, a lower platform, and at least one group of lifting components positioned between the upper and lower platforms and used for adjusting the height of the upper platform relative to the lower platform, wherein the lifting table further comprises elastic elements and a sliding component capable of sliding on the upper or lower platform; the sliding components are connected with the elastic elements for sliding on the upper or lower platform under the effect of elastic forces from the elastic elements; each sliding component comprises a push part; the push part comprises a guide surface having two ends and a flat surface, wherein one end is lower, and the other end is higher; and in the process of upward expanding the upper platform from the lowest position, the sliding component slides with the aid of the elastic force of the elastic element and enables the push part to apply an upward lifting force to the lifting component, and the upper platform displaces relative to the lower platform; when the upper platform is folded toward the lowest position, and the lifting component exerts an acting force to the push part so that the sliding component overcomes the elastic force of the elastic element to slide along the upper or lower platform.

2. The of lifting table claim 1, wherein the lifting table further comprises a first slider and a second slider; the lifting component is an X-shaped lifting arm component comprising at least one first strut and at least one second strut; the lower end of the first strut is hinged on the lower platform, the upper end of the first strut is connected with the first slider, and the first slider is slidably connected to the upper platform; the upper end of the second strut is hinged on the upper platform, the lower end of the second strut is connected with the second slider, and the second slider is slidably connected to the lower platform.

3. The of lifting table claim 2, wherein the elastic elements comprise at least one first elastic component and at least one second elastic component; one end of the first elastic component is connected with the first slider, and the other end thereof is connected to the upper platform for exerting an elastic tensile force to the first slider; one end of the second elastic component is connected with the second slider, and the other end thereof is connected to the lower platform for exerting an elastic tensile force to the second slider.

4. The of lifting table claim 3, wherein the sliding component is in sliding fit on the upper platform; one end of the first elastic component is connected with the sliding component, and the other end thereof is connected to the upper platform; the sliding component is connected with the first slider through at least one linkage mechanism.

5. The of lifting table claim 4, wherein the push part is a guide surface of which one end is low, the other end is high, and the middle is in smooth transition, arranged on the sliding component; one side of the first strut proximal the first slider is connected with a roller; when the upper platform is at the lowest position, the outer rim of the roller clings to the guide surface; when the upper platform expands upward from the lowest position, the first elastic component drives the sliding component to slide under the effect of the elastic force and enables the guide surface of the push part to push the roller so that the first strut is on the rise.

6. The of lifting table claim 5, wherein the guide surface is a bevel in linear transition or a cambered surface in smooth transition.

7. The of lifting table claim 4, wherein each linkage mechanism comprises a connecting rod, the first end of the connecting rod is rotatably connected with the first slider, and the second end of the connecting rod is connected with a limited block; the sliding component is provided with a sliding chute extending along the sliding direction of the sliding component; the limited block is received within the sliding chute by sliding fit; when the upper platform is at the lowest position, a movable space is reserved between one end of the sliding chute proximal the first slider and the limited block.

8. The of lifting table claim 4, wherein there are two linkage mechanisms, and they are arranged at two sides of the sliding component respectively.

9. The of lifting table claim 1, wherein the lifting table further comprises a locking mechanism for locking lifting height of the upper platform; an operating handle connected with the locking mechanism for controlling locking or unlocking of the locking mechanism is further disposed on the upper platform.

10. The of lifting table claim 9, wherein the locking mechanism comprises a locking bar connected with and synchronously sliding with the first slider; the lifting table further comprises a sliding bar, wherein the sliding bar has a plurality of locking teeth along the length direction; the locking mechanism also comprises a latch retainer secured on the upper platform, and at least one latch for clamping fit with the locking teeth is elastically connected inside the latch retainer; the locking mechanism further comprises a connecting plate connected with the operating handle, the end part of the connecting plate is provided with a stopper for pushing the latch, and a reset spring is disposed on the connecting plate; the locking bar penetrates through the latch retainer to fit the latch; and the connecting plate penetrates through the latch retainer to fit the latch; when pulling the operating handle to push the connecting plate so that the stopper on the connecting plate pushes the latch in the latch retainer to open towards two sides and the latch disengages the locking teeth of the locking bar, which is an unlocking state of the locking mechanism; and when releasing the operating handle so that the connecting plate resets and the latch moves toward the middle, and the latch and the locking teeth of the locking bar are clamped, which is a locking state of the locking mechanism.

* * * * *